US008011029B2

(12) United States Patent
Kamiya et al.

(10) Patent No.: US 8,011,029 B2
(45) Date of Patent: Sep. 6, 2011

(54) DRAIN SOCKET

(75) Inventors: Akinori Kamiya, Aichi-ken (JP); Keiichi Imada, Aichi-ken (JP)

(73) Assignee: Lixil Corporation, Tokyo (JP)

( * ) Notice: Subject to any disclaimer, the term of this patent is extended or adjusted under 35 U.S.C. 154(b) by 554 days.

(21) Appl. No.: 12/125,453

(22) Filed: May 22, 2008

(65) Prior Publication Data

US 2009/0288245 A1 Nov. 26, 2009

(51) Int. Cl.
*E03D 11/16* (2006.01)

(52) U.S. Cl. ..... 4/252.1

(58) Field of Classification Search ..... 4/252.1, 4/680–681; 285/56–60
See application file for complete search history.

(56) References Cited

U.S. PATENT DOCUMENTS

| | | | | |
|---|---|---|---|---|
| 670,588 | A * | 3/1901 | Hinsdale | 4/425 |
| 5,819,326 | A | 10/1998 | Kobayashi et al. | |
| 6,108,826 | A * | 8/2000 | Hayashi et al. | 4/252.1 |

FOREIGN PATENT DOCUMENTS

| | | |
|---|---|---|
| JP | 2-144085 | 12/1990 |
| JP | 8-49281 | 2/1996 |
| JP | 10-204964 | 8/1998 |
| JP | 2000-199258 | 7/2000 |
| JP | 2000-265530 | 9/2000 |
| WO | WO95/27833 | 10/1995 |

* cited by examiner

*Primary Examiner* — Charles Phillips
(74) *Attorney, Agent, or Firm* — Oblon, Spivak, McClelland, Maier & Neustadt, L.L.P.

(57) ABSTRACT

In a drain socket for a toilet stool includes a vertical pipe including an upper end connected with the discharge port of the toilet stool, an adjustable pipe extending substantially horizontally from the lower end of the vertical pipe and a connecting pipe between the adjustable pipe and a drain of a toilet. The vertical pipe has a bend causing the vertical pipe to have at its lower end an axis displaced longitudinally and rearward of the toilet stool from an axis at the upper end to define an eccentrically curved flow path. The flow path includes a part located near the bend and formed by increasing a transverse dimension of a longitudinal front end thereof with respect to the toilet stool so that the part has such a noncircular cross section in which a front portion of the section has a larger area than a rear portion of the cross section.

7 Claims, 7 Drawing Sheets

DRAIN SOCKET

FIELD OF THE INVENTION

The present invention relates to an adjustable drain socket or connector for a toilet stool.

BACKGROUND OF THE INVENTION

If a new toilet stool employed to replace an old one differs in specifications from the old one and has a discharge port differing from that of the old one in its position as viewed along the length of the toilet stool, its installation often presents a number of problems including its interference with a wall of a toilet and its installation in an extremely forwardly protruding position, since a drain in a floor of a toilet is fixed in position. In order to avoid those problems, there is available an adjustable drain socket composed of three separate parts to absorb a difference from one toilet stool to another in distance between its discharge port and the drain in the floor, as disclosed in, for example, JP-A-8-49281.

While the drain socket disclosed in the above publication enables a new toilet stool to be installed without interfering with the wall, it has been useful to absorb only a limited difference from one toilet stool to another in distance between its discharge port and the drain in the floor. Accordingly, there have been desired a drain socket which can absorb a larger such difference, and also a drain socket which can achieve an improved siphoning performance to flush the toilet stool effectively with a smaller amount of water.

SUMMARY OF THE INVENTION

Under these circumstances, it is an object of the present invention to provide an improved drain socket for a toilet stool. This object is attained by a drain socket for a toilet stool which comprises a vertical pipe including an upper end connected with a discharge port of the toilet stool, an adjustable pipe extending substantially horizontally from a lower end of the vertical pipe and a connecting pipe between the adjustable pipe and a drain in the floor of a toilet, wherein the vertical pipe has a bend causing the vertical pipe to have at a lower end thereof an axis displaced longitudinally and rearward of the toilet stool from an axis thereof at the upper end to thereby define an eccentrically curved flow path, and the flow path includes a part which is located near the bend and formed by increasing a transverse dimension of a longitudinal front end thereof with respect to the toilet stool so that said part has such a noncircular cross section in which a front portion of the section has a larger area than a rear portion of the cross section.

The vertical pipe preferably has an upper portion and a lower portion joined together in the vicinity of the bend thereof.

The flow path preferably has at least in the vicinity of the bend a cross-sectional contour defined by a greater dimensional reduction as viewed transversely of the toilet stool than as viewed longitudinally of the toilet stool in the direction in which the flow path is eccentrically curved.

According to the present invention, in the drain socket comprising a vertical pipe including an upper end connected with a discharge port of a toilet stool, an adjustable pipe extending substantially horizontally from a lower end of the vertical pipe and a connecting pipe between the adjustable pipe and a drain in the floor of a toilet, the vertical pipe has a bend causing the vertical pipe to have at a lower end thereof an axis displaced longitudinally and rearward of the toilet stool from an axis thereof at the upper end to thereby define an eccentrically curved flow path, and the lower end of the vertical pipe having a rearward displaced axis makes it possible to adapt a toilet stool for installation in a wide range of drain positions and absorb a wide range of difference from one toilet stool to another in distance between its discharge port and the drain in the floor.

The bend defining an eccentrically curved flow path creates resistance to flushing water and produces a siphoning action rapidly to flush the toilet bowl effectively with a small amount of water.

The vertical pipe having an upper portion and a lower portion joined together in the vicinity of the bend makes it possible to remove it from a mold easily and thereby facilitate its manufacture.

The flow path having at least in the vicinity of the bend a cross-sectional contour defined by a greater dimensional reduction as viewed transversely of the toilet stool than as viewed longitudinally of the toilet stool in the direction in which the flow path is eccentrically curved, exhibits an improved siphoning performance without lowering its anti-clogging property and makes it possible to flush the toilet bowl with a small amount of water. While the flow path has its cross-sectional dimensions reduced to produce a siphoning action when it is filled with water, it has a greater cross-sectional dimensional reduction transversely of the toilet stool to retain its good anti-clogging property, since a greater cross-sectional dimensional reduction longitudinally of the toilet stool in the direction in which the flow path is eccentrically curved would make it likely for the flow path to be clogged with waster matter easily.

DETAILED DESCRIPTION OF THE INVENTION

Description will now be made of a preferred embodiment of the present invention with reference to the drawings.

Figure 1:
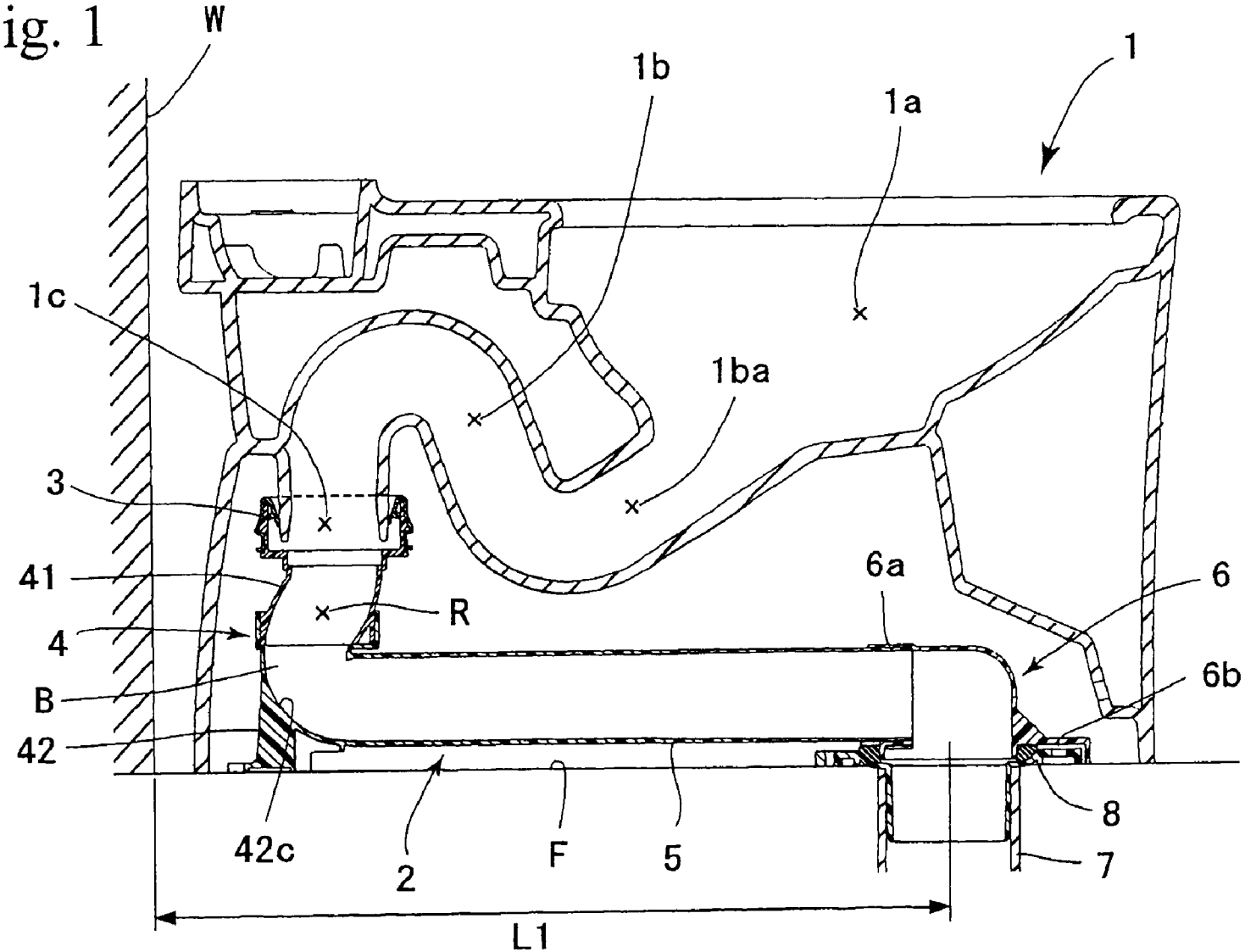
FIG. 1 is a vertical sectional view of a toilet stool installed with a drain socket.

FIG. 1 is a vertical sectional view of a toilet stool installed with a drain socket embodying the present invention. The toilet stool 1 has a bowl portion 1*a*, and a substantially inverted U-shaped trap passage 1*b* formed downstream of the bowl portion 1*a* and having an inlet 1*ba* defined by a straight inflow passage inclined downward from the bowl portion 1*a*. The bowl portion 1*a* has a substantially straight bottom contour extending from its front end to the inlet 1*ba* of the trap passage 1*b*, so that flushing water may flow into the trap passage 1*b* effectively at a sufficiently high velocity to discharge waste matter with a small amount of water. The straight inflow passage at the inlet 1*ba* of the trap passage 1*b* preferably has a length of at least 20 mm.

A discharge port 1*c* opening toward a floor F and facing downward is defined at the downstream end of the trap passage 1*b*.

Figure 3:
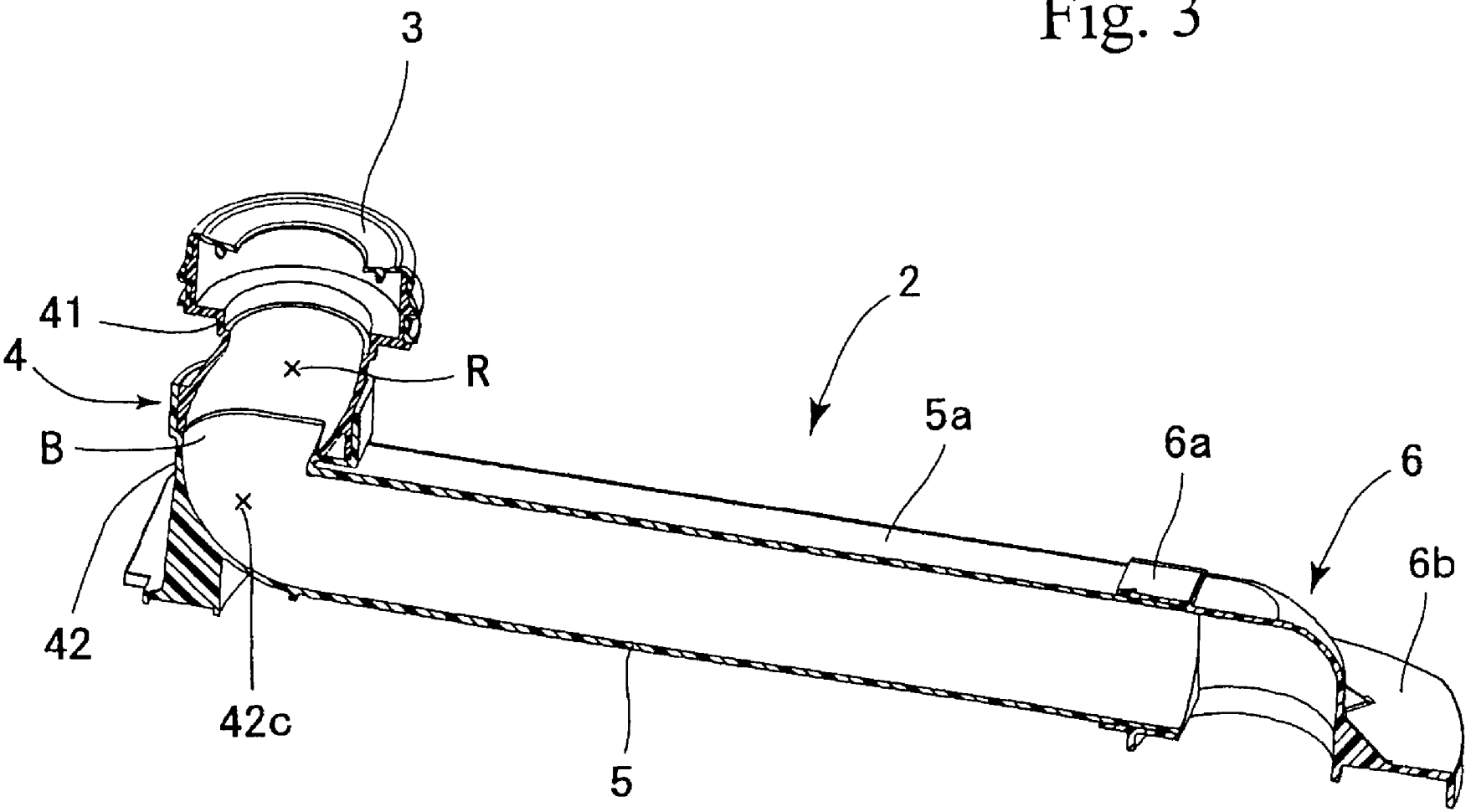
FIG. 3 is a perspective view, partly in section, of a drain socket.

A drain socket 2 is employed to connect the discharge port 1*c* and a drain 7 buried under the floor F. The drain socket 2 comprises a vertical pipe 4, an adjustable pipe 5 extending substantially horizontally from the lower end of the vertical pipe 4 and a connecting pipe 6 fitted about the adjacent end of the adjustable pipe 5 and defines therein a flow path R for waste liquids, as shown by a perspective view, partly in section, thereof in FIG. 3.

Figure 2:
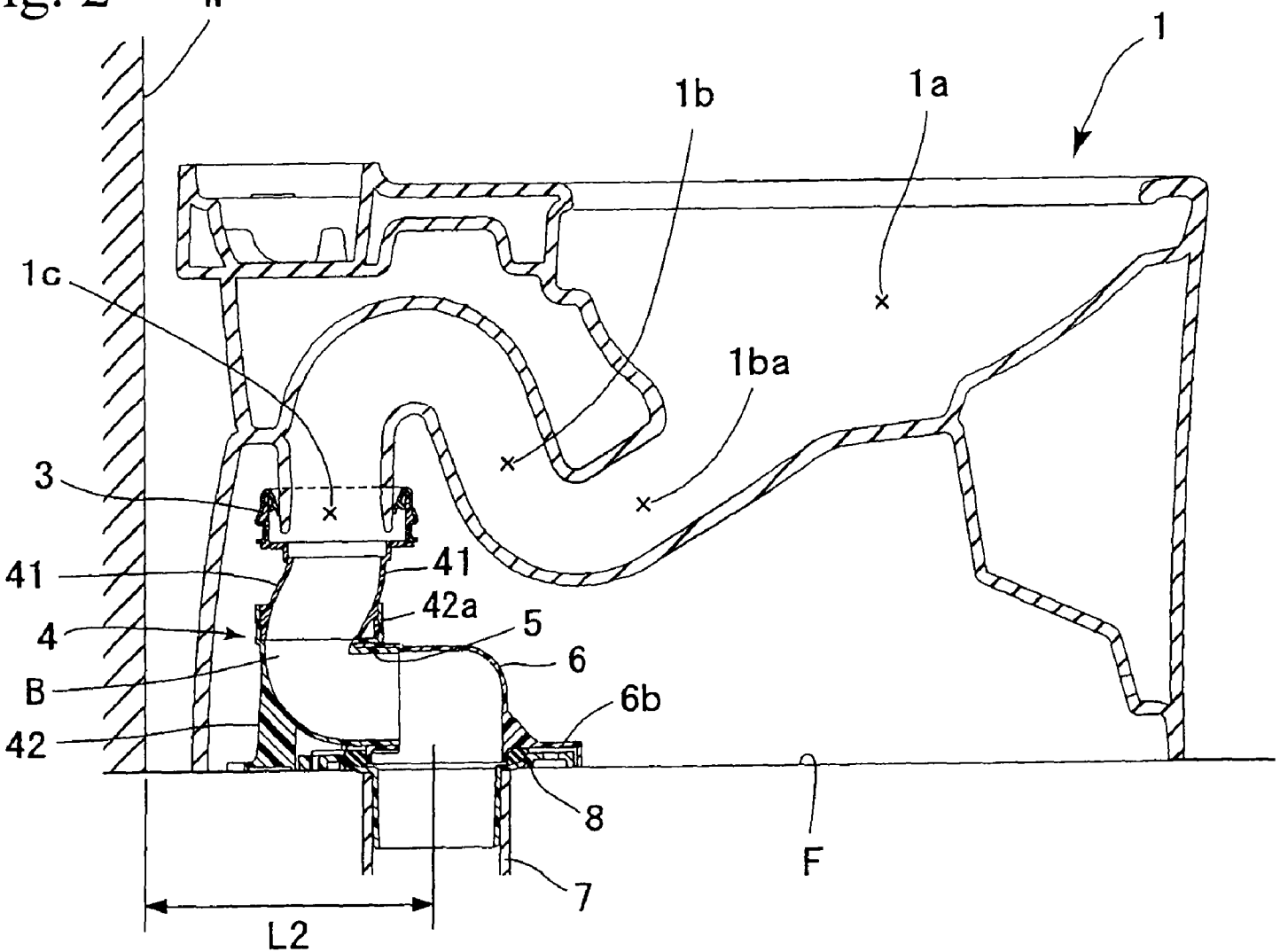
FIG. 2 is a vertical sectional view of a toilet stool installed with a drain socket at a minimum distance from a drain in the floor.

The drain socket 2 can be used to install the toilet stool in a proper position in a toilet if its adjustable pipe 5 is cut appropriately as required to suit a drain distance L1 between the wall W of the toilet and the centerline of the drain 7. FIG. 1 shows the adjustable pipe 5 connected with the connecting pipe 6 without being cut at all to install the toilet stool 1 at a maximum drain distance L1, while FIG. 2 shows the toilet stool 1 installed at a minimum drain distance L2 to which the adjustable pipe 5 is adaptable.

According to a salient feature of the present invention, the vertical pipe 4 has a bend B displacing the flow path R rearward toward the wall W. The bend B makes the minimum drain distance L2 shorter by the amount of its displacement than has hitherto been available, and makes the difference between the maximum and minimum drain distances L1 and L2 larger, thereby providing a greater allowance for the designing and installation of toilet stools.

Moreover, the bend B creates a greater resistance to flushing water and produces a siphoning action rapidly to flush the toilet bowl effectively with a small amount of water.

Figure 4:
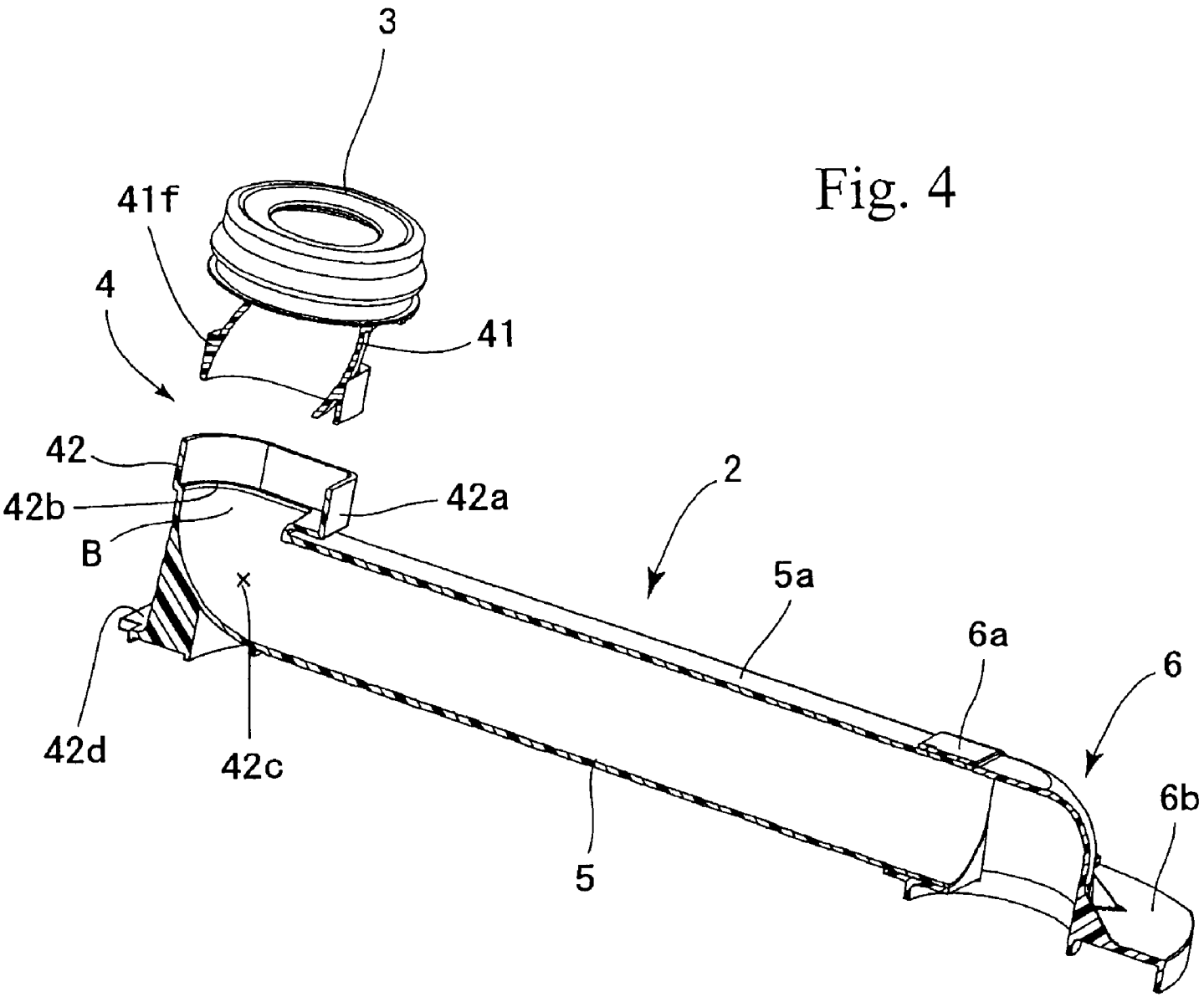
FIG. 4 is an exploded perspective view, partly in section, of the drain socket with its vertical pipe yet to be connected.

The vertical pipe 4 having the bend B is composed of two separate members, an upper member 41 and a lower member 42, as shown in an exploded way in FIG. 4, and is assembled by having the upper member 41 fitted in the lower member 42. The lower member 42 forms a single continuous structure with the adjustable pipe 5 connected to the lower end.

Figure 5:
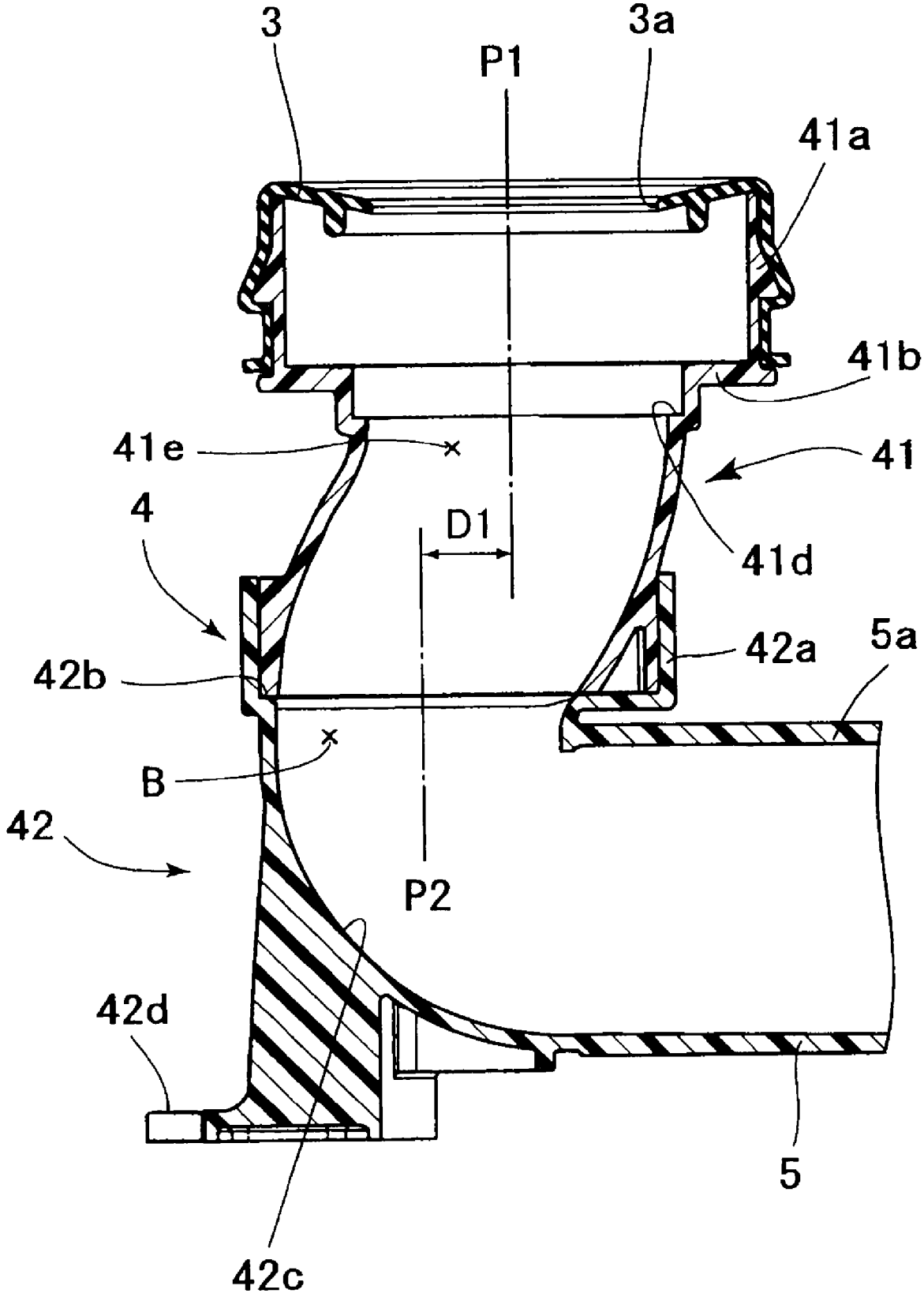
FIG. 5 is an enlarged vertical sectional view of the vertical pipe of the drain socket.

Referring to the enlarged vertical sectional view in FIG. 5, the axis P1 of the upper member 41 of the vertical pipe 4 and the axis P2 of its lower member 42 are displaced from each other by a distance D1 of 20 mm and its lower member 42 is displaced from its upper member 41 rearward toward the wall W by a distance of 20 mm. The bend B extends from the upper member 41 to the lower member 42 and has a lower end terminating in a mildly curved portion 42*c* connected to the adjustable pipe 5. The curved portion 42*c* promotes the flow of waste matter and its discharge into the adjustable pipe 5.

Figure 6:
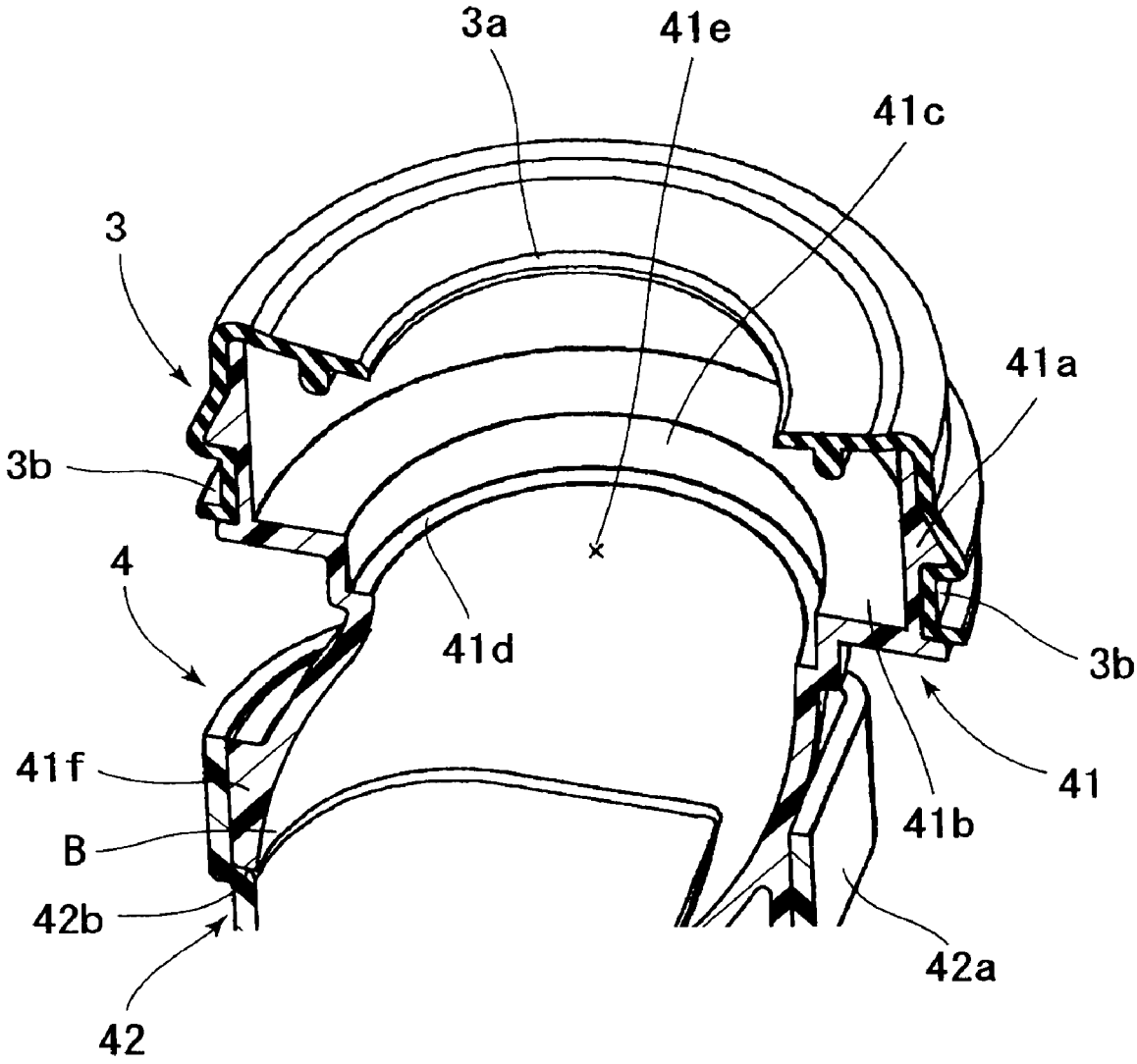
FIG. 6 is an enlarged perspective view, partly in section, of an upper member for the vertical pipe of the drain socket.

The upper member 41 of the vertical pipe 4 has a cylindrical upward extension 41*a* having a projection on its outer circumferential surface like one of a bamboo shoot, as shown by an enlarged perspective view, partly in section, in FIG. 6. The upward extension 41*a* has its outer circumferential and top surfaces covered with a rubber gasket 3 having a top opening 3*a* in which the discharge port 1*c* of the toilet stool can be connected.

The rubber gasket 3 is held in position by the projection on the upward extension 41*a*. The rubber gasket 3 has a recess 3*b* formed along the lower edge of its outer circumferential surface to receive therein a tightening belt not shown, whereby the rubber gasket 3 is rigidly held on the upward extension 41*a*.

The upward extension 41*a* has a horizontal portion 41*b* projecting radially inwardly and substantially horizontally from its lower end, a vertical portion 41*c* extending downward from the inner end of the horizontal portion 41*b* and a shelf portion 41*d* extending radially inwardly and substantially horizontally from the lower end of the vertical portion 41*c* and having an inner periphery defining a circular inlet 41*e* having a diameter of 58 mm.

The bend B extends downward from the shelf portion 41*d* and is curved rearward. An insert portion 41*f* of increased wall thickness is formed on the outer periphery of the upper member 41 toward its lower end as an integral part thereof.

A joint forming portion 42*a* having an open top is formed at the top of the lower member 42 of the vertical pipe 4 and has a lower surface defining a radially inwardly extending engaging shoulder 42*b*. The insert portion 41*f* of the upper member 41 is fitted into the joint forming portion 42*a* until its lower end engages the engaging shoulder 42*b*, and the insert portion 41*f* and the joint forming portion 42*a* are put together into a unitary assembly using an adhesive at a factory. This makes it possible to reduce the jobs of connecting parts at the site of installation and thereby any possibility of water leakage that might otherwise be high.

Figure 7:
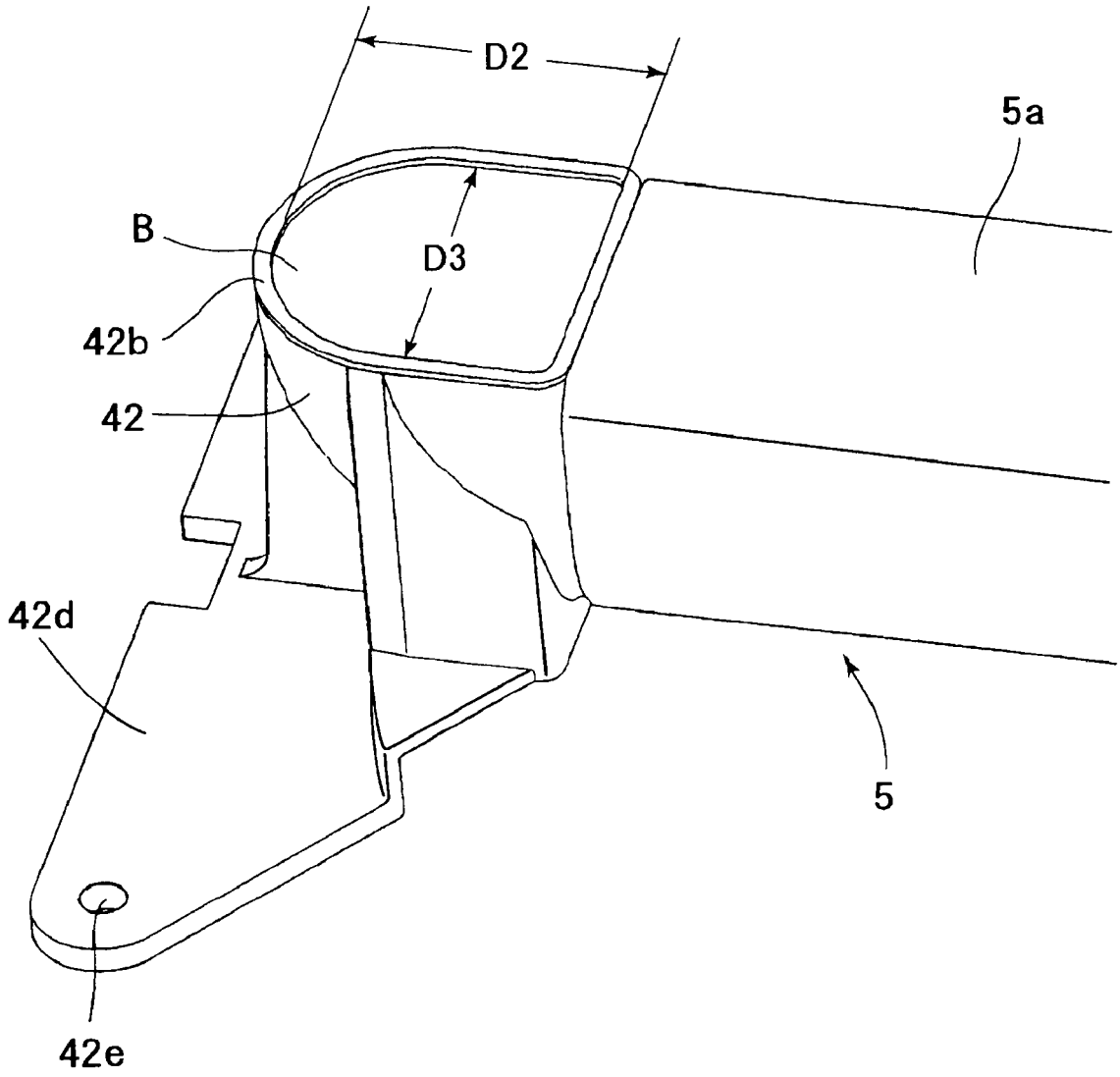
FIG. 7 is an enlarged fragmentary perspective view of a lower member for the vertical pipe of the drain socket and its adjustable pipe.

FIG. 7 is a perspective view showing the engaging shoulder 42*b* exposed by cutting the lower member 42 horizontally. As is obvious therefrom, the flow path R in the vicinity of the engaging shoulder 42*b* has a substantially D-shaped cross section with a longitudinal dimension D2 of 55 mm and a transverse dimension D3 of 53 mm. In other words, the flow path R in the vicinity of the engaging shoulder 42*b* in the bend B has a cross-sectional contour defined by a transverse dimensional reduction which is greater than its longitudinal dimensional reduction.

While the flow path R has its cross-sectional dimensions reduced to promote a siphoning action, it has a greater cross-sectional dimensional reduction transversely of the toilet stool to achieve an improved siphoning performance without lowering its anti-clogging property, since a greater cross-sectional dimensional reduction longitudinally of the toilet stool in the direction in which the flow path is eccentrically curved (i.e. in the direction of flow of water) would make it likely for the flow path to be clogged with waster matter easily. Thus, it is possible to flush the toilet bowl with a small amount of water.

A mounting flange 42*d* is formed on the outside of the lower member 42 of the vertical pipe 4 as an integral part thereof and has a screw hole 42*e* through which a screw can be passed to secure the drain socket 2 to the floor F.

The adjustable pipe 5 extends horizontally from the lower member 42 in a way forming a single structure with it, has a substantially horizontal flat upper surface 5*a* and defines therein a flow path having a substantially D-shaped cross section with a minimum diameter of 56 mm. When the adjustable pipe 5 has been manufactured, a mold is moved to the right as viewed in the drawings for its removal from the product, and the adjustable pipe 5 has a forward gradient of 1/200 formed toward the connecting pipe 6 by the mold. This ensures that no water remains in the adjustable pipe 5 and forms any dew thereon.

The vertical pipe 4 is easy to manufacture, since its separate upper and lower members 41 and 42 are easy to remove from the mold.

The shelf portion 41*d* formed in the upper member 41 of the vertical pipe 4 receives flushing water from the discharge port 1*c* of the toilet stool 1 and causes it to flow along the inner wall toward the center of the flow path R. Thus, the shelf portion 41*d* concentrates flushing water from the discharge port 1*c* toward the center of the flow path to thereby produce a high siphoning power.

The connecting pipe 6 has a diametrically enlarged receiving portion 6*a* formed at one end thereof for receiving therein the adjacent end of the adjustable pipe 5 and a mounting flange 6*b* formed at the opposite end where the connecting pipe is secured to the floor F.

Although the lower member 42 of the vertical pipe 4 and the adjustable pipe 5 have been shown as forming a single continuous structure, it is also possible to prepare them as two separate products which can be connected to each other.

What is claimed is:

1. A drain socket for a toilet stool comprising:

a vertical pipe including an upper end connected with a discharge port of the toilet stool, an adjustable pipe extending substantially horizontally from a lower end of the vertical pipe and a connecting pipe between the adjustable pipe and a drain in the floor of a toilet, wherein:

the vertical pipe has a bend causing the vertical pipe to have at a lower end thereof an axis displaced longitudinally and rearward of the toilet stool from an axis thereof at the upper end to thereby define an eccentrically curved flow path; and the flow path includes a part which is located near the bend and shaped by increasing a transverse dimension of a longitudinal front end thereof with respect to the toilet stool so that said part has such a noncircular cross section in which a front portion of the section has a larger area than a rear portion of the cross section.

2. A drain socket according to claim 1, wherein the vertical pipe has an upper portion and a lower portion joined together in the vicinity of the bend thereof.

3. A drain socket according to claim 1, wherein the flow path has, at least in the vicinity of the bend, a cross-sectional contour defined by a greater dimensional reduction as viewed transversely of the toilet stool than as viewed longitudinally of the toilet stool in the direction in which the flow path is eccentrically curved.

4. A drain socket according to claim 2, wherein the flow path has, at least in the vicinity of the bend, a cross-sectional contour defined by a greater dimensional reduction as viewed transversely of the toilet stool than as viewed longitudinally of the toilet stool in the direction in which the flow path is eccentrically curved.

5. A drain socket according to claim 2, wherein the lower portion includes a joint forming portion that joins the lower portion to the upper portion, wherein the joint forming portion receives the upper portion.

6. A drain socket according to claim 5, wherein the joint forming portion is bonded to an insert portion of the upper portion via an adhesive.

7. A drain socket according to claim 5, wherein the lower portion includes a D shaped cross section.

* * * * *